US009278517B2

(12) United States Patent
Watanabe

(10) Patent No.: US 9,278,517 B2
(45) Date of Patent: Mar. 8, 2016

(54) INK JET PRINTER

(71) Applicant: CANON KABUSHIKI KAISHA, Tokyo (JP)

(72) Inventor: Ryota Watanabe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/202,601

(22) Filed: Mar. 10, 2014

(65) Prior Publication Data

US 2014/0267483 A1 Sep. 18, 2014

(30) Foreign Application Priority Data

Mar. 15, 2013 (JP) ..... 2013-053864

(51) Int. Cl.

| | |
|---|---|
| ***B41J 2/045*** | (2006.01) |
| ***B41J 2/14*** | (2006.01) |
| ***B41J 2/175*** | (2006.01) |
| ***B41J 29/393*** | (2006.01) |

(52) U.S. Cl.

CPC ..... *B41J 2/0451* (2013.01); *B41J 2/14072* (2013.01); *B41J 2/17526* (2013.01); *B41J 2/17546* (2013.01); *B41J 29/393* (2013.01)

(58) Field of Classification Search

CPC .... B41J 2/0458; B41J 2/0451; B41J 2/04563; B41J 29/393; B41J 2/04581; B41J 2/04591

See application file for complete search history.

(56) References Cited

U.S. PATENT DOCUMENTS

| | | | | |
|---|---|---|---|---|
| 6,705,694 | B1 * | 3/2004 | Barbour et al. | 347/9 |
| 7,419,236 | B2 * | 9/2008 | Masuda | 347/14 |
| 8,152,277 | B2 | 4/2012 | Hatasa et al. | |
| 2010/0002057 | A1 * | 1/2010 | Hatasa et al. | 347/50 |

FOREIGN PATENT DOCUMENTS

JP 2006-297826 A 11/2006

* cited by examiner

*Primary Examiner* — Alessandro Amari
*Assistant Examiner* — Jeremy Delozier
(74) *Attorney, Agent, or Firm* — Fitzpatrick, Cella, Harper & Scinto

(57) ABSTRACT

To provide an ink jet printer capable of reliably detecting a poor connection of connection terminal of a print head in a short time without wasting ink. For that end, a print head is mounted on a carriage, and power is supplied from a capacitor to a heater before charging ink to the print head, so as to determine the presence of voltage drop.

4 Claims, 6 Drawing Sheets

INK JET PRINTER

BACKGROUND OF THE INVENTION

1. Field of the Invention

The present invention relates to an ink jet printer provided with a print head which ejects ink, and more specifically to an ink jet printer which confirms an electrical connection at the time of mounting a detachable print head on a carriage on a printer main body.

2. Description of the Related Art

An ink jet printer (hereinafter also referred to simply as a printing apparatus) is a printing apparatus which carries out the printing on a print medium by mounting a print head which ejects ink from an ejection port on a carriage, and causing the carriage to travel in parallel with a platen which supports the printing medium at the time of printing. There is a print head structured so that the carriage can be detachable thereto, and an electrode for electrical connection with the carriage is provided on the print head. The electrode of the print head is brought into contact with an electrode with an elastic action which is provided on the carriage, so that the electrical connection with the printing apparatus main body is established to transmit a signal and supply power from the printing apparatus to the print head.

In such a printing apparatus in which the print head can be replaced, mounting operation of the print head by a user is carried out at the time of initial installation and replacing the print head because of the end of life of the print head. At that time, it is highly likely that ejection cannot be done properly if inadequacy occurs in mounting of the print head to generate a poor connection in a part of connection elements. Therefore, in this case, it is preferable to give a user notice of inadequate mounting of the print head in the early stage after the mounting.

As a technology for addressing such a problem, Japanese Patent Laid-Open No. 2006-297826 discloses a method for confirming an electrical connection between a print head and a printing apparatus using a connection terminal located in the corner of the print head as a terminal for detecting the contact. Also, there is a method in which a pattern for confirming the ejection from an ejection port is printed in the state where ink is charged to the print head, and a poor connection of some of connection terminals is recognized on the basis of the printed result.

However, the method disclosed in Japanese Patent Laid-Open No. 2006-297826 merely confirms an alignment on a connection surface to determine the status of mounting the print head. It is thus impossible to sense the connection status of individual terminals in detail, such as inclusion of tiny flecks of waste. In actuality, the print head is hardly mounted to be significantly inclined in terms of mechanical structure, and most of poor connections may depend on individual terminals. Then, when the poor connections occur in the individual terminals, a user confirms a printed object to recognize that proper printing has not been done, or a user is notified the sensed result by an automatic ejection sensing function in the conventional case. Then, a user remounts the print head as an action for addressing it afterwards.

In such a press contact type of connection mechanism, although a number of measures other than that is taken to prevent the individual poor connections, the poor connections have not been completely eliminated. However, the press contact type of connection mechanism is widely used on the grounds of easiness of removability and low cost, while being press contact type makes it difficult to completely eliminate the poor contact due to inclusion of tiny flecks of waste.

Therefore, assuming that the remounting by a user is admitted as described above, the user may face the following two disadvantages. One is that replacement operation has to be performed after temporarily releasing ink supplied to the print head if the poor contact is revealed after the actual printing or automatic detection of the ejection. This of course results in waste of ink.

The other disadvantage is that the contact is confirmed merely after supplying ink to the print head, and the occurrence of the poor connection accordingly leads to significant extension of preparation time in total. In other words, the problem to be solved is in what way the poor contact of the connection terminal can be detected before starting the supply of ink to the print head.

SUMMARY OF THE INVENTION

Therefore, the purpose of the present invention is to provide an ink jet printer capable of reliably detecting a poor connection of a connection terminal of a print head in a short time.

A feature of an ink jet printer of the present invention is to be provided with a print head for ejecting ink from an ejection port using an energized energy element, a carriage to which the print head can be mounted, an energization means capable of energizing the energy element; and a determination means for determining that the print head is correctly mounted in the case where power is supplied to the energy element using the energization means after mounting the print head on the carriage, and a voltage drop is sensed in the energization means.

It is thus possible to achieve an ink jet printer capable of reliably detecting a poor connection of a connection terminal of a print head in a short time.

Further features of the present invention will become apparent from the following description of exemplary embodiments (with reference to the attached drawings).

DESCRIPTION OF THE EMBODIMENTS (First Embodiment)

A first embodiment of the present invention will be described below with reference to drawings.

Figure 6A:
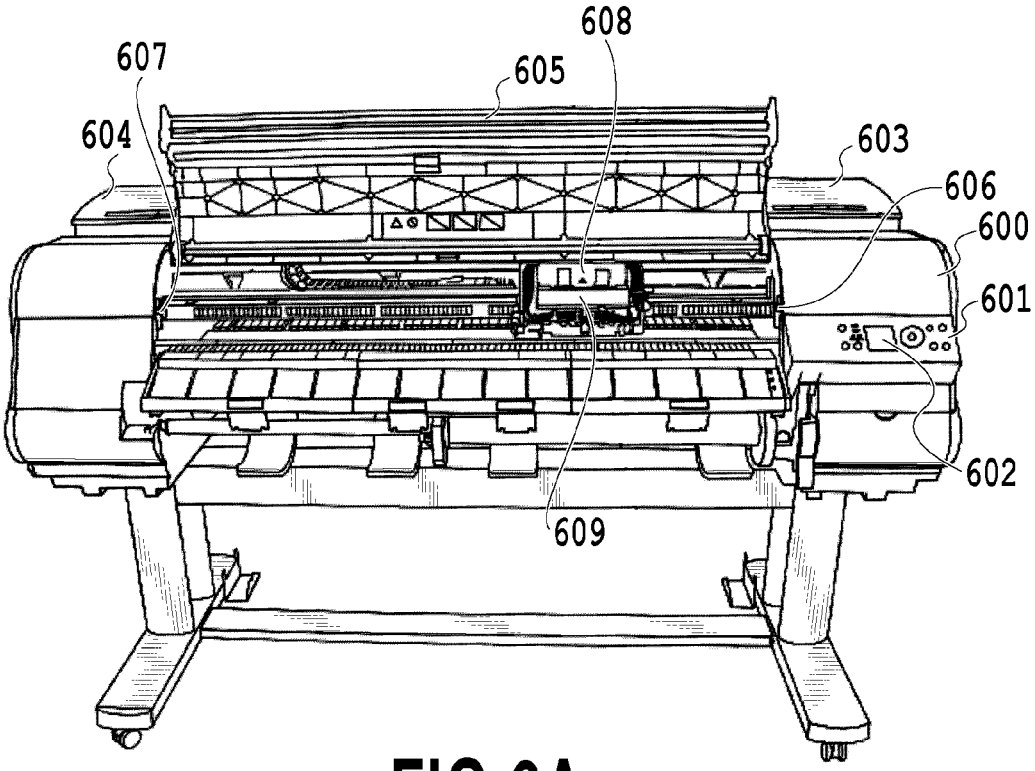
FIG. 6A is a diagram showing an overall structure of an ink jet printer main body.

FIG. 6A is a diagram showing an overall structure of a main body of an ink jet printer (hereinafter also simply referred to as a printing apparatus). An operating portion 601, which is used when a user operates a main body, has an integrated operation display portion (LCD) 602. A dust cover 605 is a cover which prevents dust from entering the printing apparatus, and prevents a user from touching a movable portion while printing. Dust cover opening/closing sensing switches 606 and 607 are provided on both the right and left sides, and it is recognized that the dust cover is closed when both the switches are closed.

A head cover 609 is opened and closed at the time of mounting the print head on a carriage 608. Furthermore, the operating portion 601, the operation display portion 602, and the dust cover opening/closing sensing switches 606 and 607 are directly or indirectly connected to a CPU 200 described below. Then, the operation by a user gives a trigger for the operation of the CPU 200, and an instruction by the CPU 200 produces a display on the operation display portion 602 in accordance with the operation mode.

Figure 5:
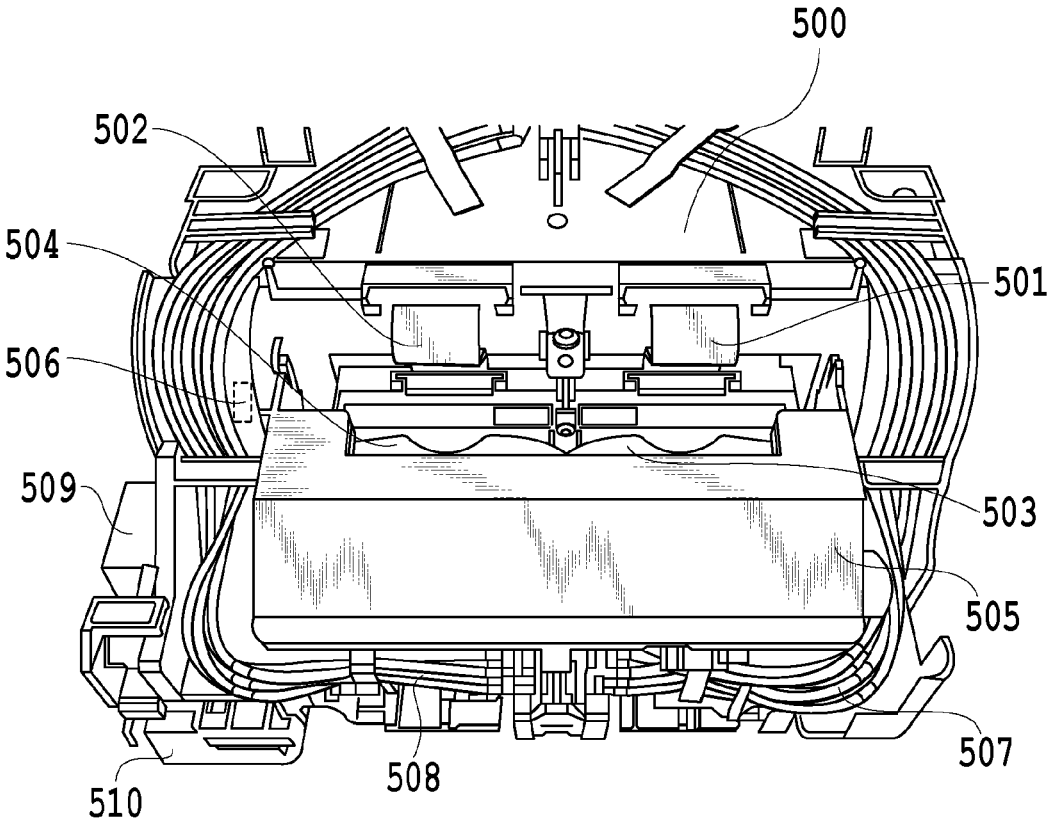
FIG. 5 is a diagram showing the periphery of a carriage in detail which is a type of mounting a print head.

FIG. 5 is a diagram showing the periphery of the carriage in detail on which two print heads can be mounted. Head clampers 503 and 504 are provided on both the right and left sides, respectively, in order to securely fix the print heads to the carriage 500, and a head cover 505 is provided for preventing dust from entering from further upper portion. Furthermore, the CPU can sense the opening and closing of the head cover 505 by means of a photo interrupter 506, which can be used by a user for determining in what status the print head is at the time of replacing the print head. The printing apparatus is provided with an ink tank (not shown), and ink is supplied from the ink tank to the print head by the instruction from the printing apparatus.

Figure 6B:
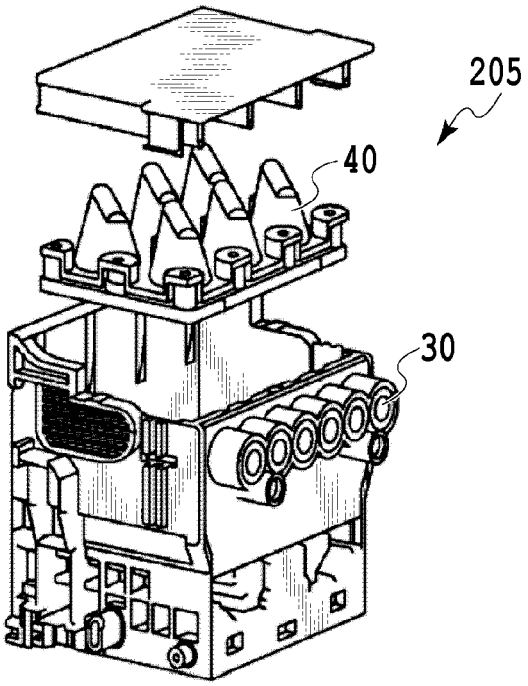
FIG. 6B is a diagram showing a print head.

FIG. 6B shows a perspective view showing the partially exploded print head which can be detachably mounted on the carriage. The print head 205 is supplied with ink by connecting portions 30 from the printing apparatus main body through a supplying tube 507. Then, the ink supplied by the connecting portions 30 is temporarily stored in reservoir sections (not shown) provided for each color of ink, and then ejected from a plurality of ejection ports provided on an ejection port surface to carry out the printing operation. Furthermore, the reservoir sections are provided with pressure adjustment members 40 connected thereto which are formed by an elastically deformable rubber member. Change in capacities of the pressure adjustment members 40 makes it possible to adjust the pressure inside the reservoir sections. Furthermore, the print head 205 is provided with terminals T1 to T6 for making an electrical connection to the printing apparatus main body.

Figure 2:
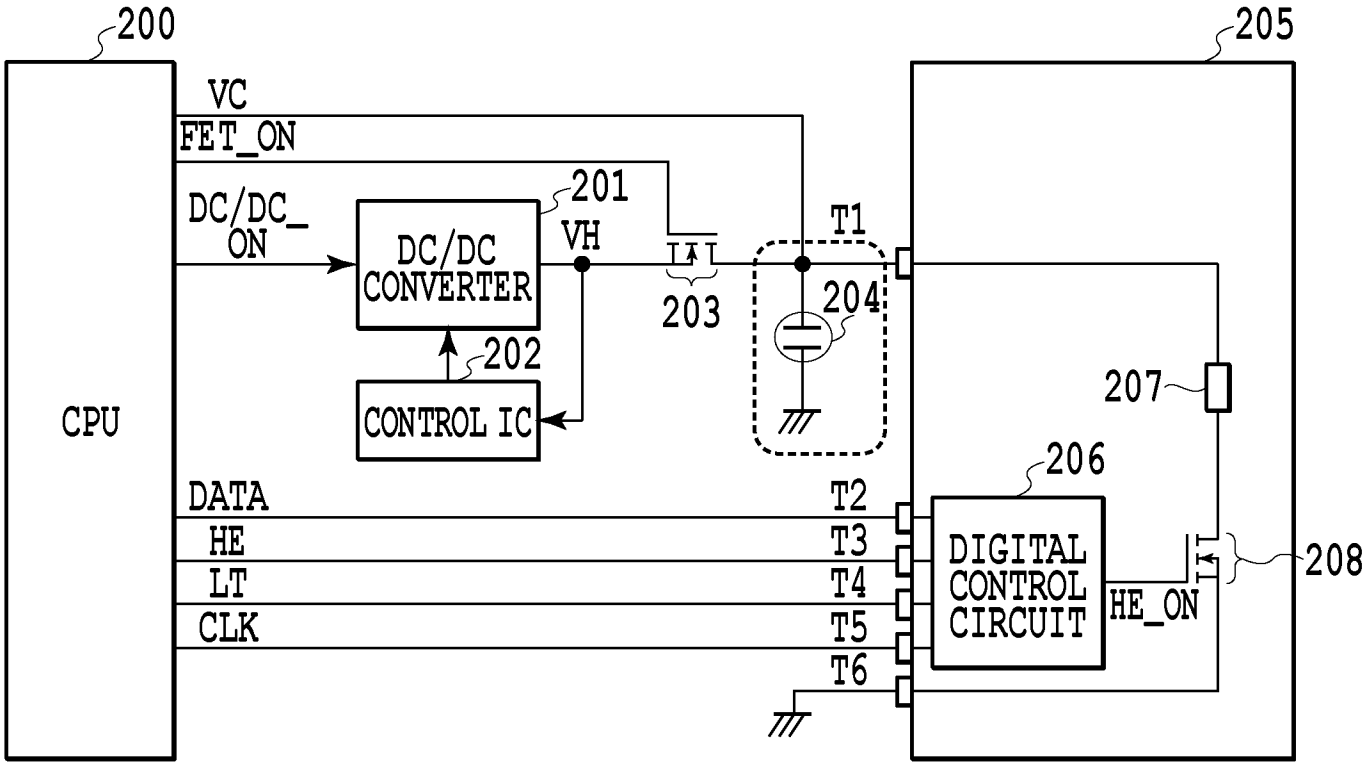
FIG. 2 is a block diagram showing an electrical connection in a printing apparatus main body.

FIG. 2 is a block diagram showing an electrical connection between the printing apparatus main body and the print head in the present embodiment. The CPU 200 carries out the overall control of the printing apparatus main body. A DCDC converter 201 generates a driving voltage (VH) for the print head 205, and is controlled its output voltage to be appropriate by a control IC 202. A field-effect transistor 203 is a transistor of field-effect type which turns on/off of VH in response to an instruction from the CPU. A capacitor 204 is a capacitor which acts as a backup of VH, and an output VC thereof is input to an AD converter of the CPU 200 through a voltage dividing circuit (not shown).

The print head 205 has an integrated heater resistor 207 corresponding to each of the ejection ports as being energy elements for ejecting ink from the ejection ports, and an integrated FET 208 as a switch for turning on/off the heater resistor 207. Here, although a single heater resistor and FET 208 are illustrated in order to show the concept, there are actually a great number of heater resistors and FETs. A digital control circuit 206 executes ON/OFF control of a predetermined FET based on each of control signals CLK, DATA, LT and HE which is input from the CPU.

Figure 1:
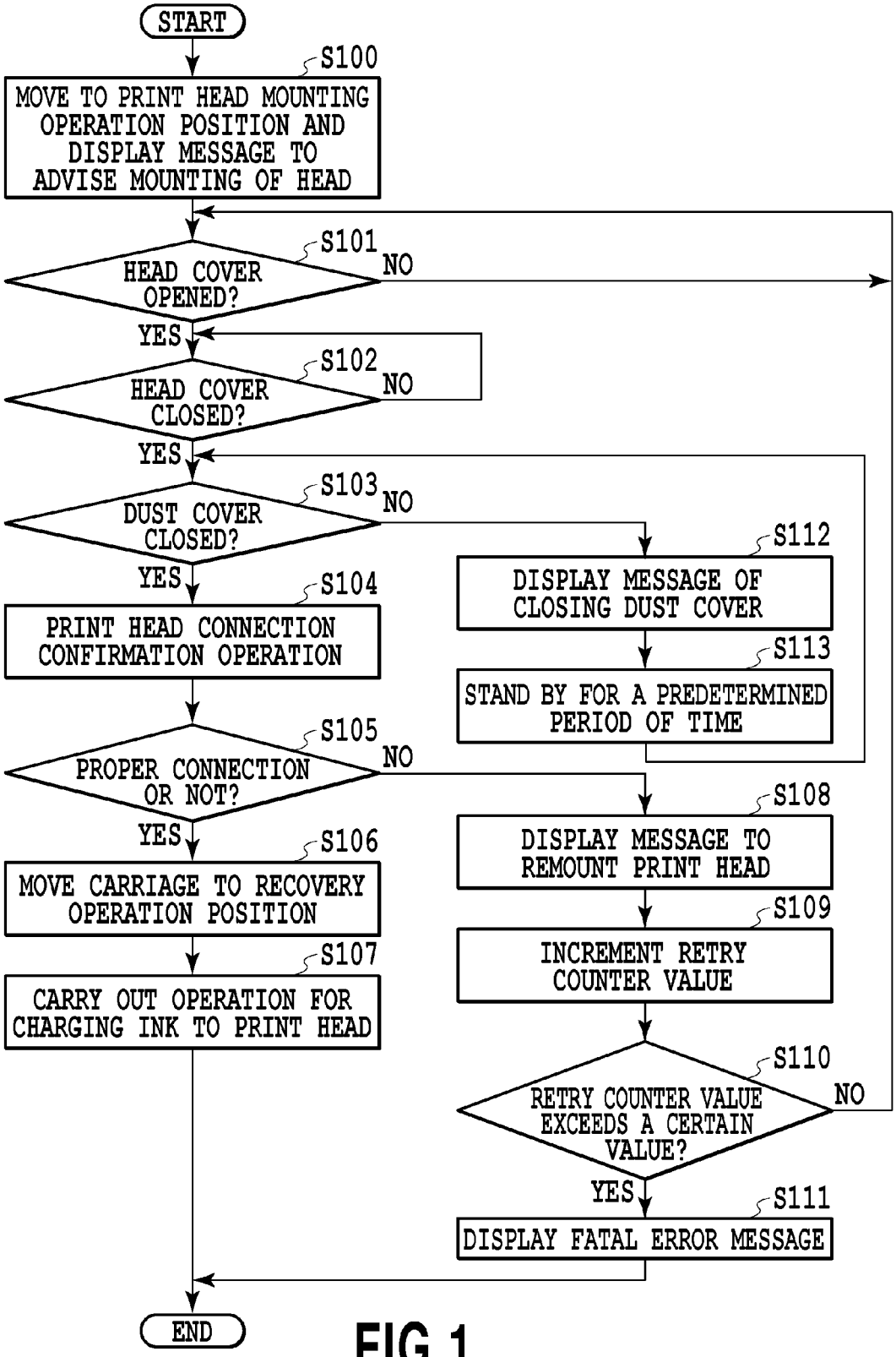
FIG. 1 is a flow chart explaining an operation at the time of mounting a print head on a main body.

FIG. 1 is a flow chart explaining the operation when the print head is mounted on the main body by a user for the first time. It will be described below based on FIG. 1 how the first embodiment of the present invention operates.

When the replacement operation is required for the print head, a user operates a button of the operating portion (601 in FIG. 6A) on the printing apparatus main body so that a command of print head replacement mode is issued at step 100. When the command of the print head replacement mode is given, the carriage moves to the print head mounting operation position on the printing apparatus main body, and then a massage for advising the replacement of the print head is displayed on the LCD (602 in FIG. 6A) located in the vicinity of the operating portion. Then, it is determined whether the head cover 505 is opened at step S101. If the head cover 505 is closed, the CPU 200 stands by until the head cover 505 is opened.

Sensing of the opening/closing of the head cover 505 is done by a photo interrupter (506 in FIG. 5). The purpose thereof is to recognize whether or not a user starts the operation to open the head cover 505 for mounting the print head. Then, at step S102, it is confirmed whether or not the user completes the replacement of the print head and closes the head cover 505. The CPU 202 proceeds to the next step if the close of the head cover 505 is sensed after the print head is mounted, while, if not sensed, standing by until the close of the head cover 505 is sensed. The purpose thereof is to recognize that a user closes the head cover 505 and thus finishes the mounting of the print head. Furthermore, in the printing apparatus main body, a massage of closing the head cover 505 is displayed on the LCD 602 in the vicinity of the operating portion to advise a user of the printing apparatus to execute the operation.

At step S103, the CPU 200 confirms whether the dust cover (605 in FIG. 6A) is closed. If it is sensed that the dust cover is closed, the procedure proceeds to next step. If it is not sensed that the dust cover 605 is closed, the procedure proceeds to step S112. A message indicating the close of the dust cover is displayed on the LCD 602 in the vicinity of the operating portion at step S112. Then, the CPU stands by for a certain period of time at step S113, and confirms again whether the dust cover 605 is closed at step S103. The purpose of the processing here is to recognize that a user closes the dust cover 605 and thus finishes the preparation for proceeding to the next operation for charging ink.

Then, at step S104, the CPU 200 executes the operation of confirming electrical connection between the print head 205 and the printing apparatus main body. The operation will be described below in detail, but the important thing is to conduct the operation of confirming electrical connection before ink is charged. Then, it is confirmed at step S105 whether a connection is properly established. The procedure proceeds to step S106 if it is determined to be proper, whereas the procedure proceeds to step S108 if it is determined that a connection is poor.

At step S106, the carriage 608 on the printing apparatus main body is moved to the recovery operation position. The recovery operation position refers to the position for the operation where the suction operation is executed for refreshing ink in the print head, and the wipe operation is executed for cleaning a surface. At the following step S107, the operation for charging ink to the print head is executed. This operation is conducted by conducting the suction operation for refreshing ink in the print head for an extra period of time. The ink charge operation is finished at step S107, and then the mounting the print head on the printing apparatus main body is completed.

On the other hand, if it is determined that the connection is poor at step S105, a massage of remounting the print head is displayed on the LCD 602 in the vicinity of the operating portion to advise a user to execute the operation. Then, at step S109, the CPU 200 increments the retry counter value. Then, at step S110, the CPU 200 determines whether the retry counter value exceeds a predetermined value. The procedure then returns to step S101 if the retry counter value does not exceed the predetermined value.

In contrast, if the retry counter value exceeds the predetermined value, the procedure proceeds to step S111. At step S111, the retry counter value exceeds a certain value, so that a fatal error message is displayed on the LCD 602 located in the vicinity of the operating portion to advise a user to execute the operation, and then the procedure is terminated.

Next, the processing at step S104, i.e., a method for confirming the electrical connection between the print head 205 and the printing apparatus main body will be described in detail using FIG. 2. When confirming the electrical connection between the print head 205 and the printing apparatus main body, the CPU 200 gives the print head 205 a control signal to turning off all of the heaters. This is performed using a serial control signal to give the print head 205 a selection signal for providing no power to all of the heaters, and prohibit a signal to control heating time (HE in figure). In the state where such an instruction is given to the print head 205, the DCDC converter 201 and the FET 203 are turned on. Then, the FET 203 is turned off after confirming that the voltage of the capacitor 204 reaches a predetermined value or a reasonable period of time has elapsed.

Then, the CPU 200 uses a serial control signal to give the print head 205 a selection signal to provide power to a predetermined heater resistor. As a result, charges accumulated in the capacitor 204 are discharged through a predetermined heater resistor, thereby lowering the voltage of the capacitor 204. If poor contact occurs in the connecting portion and thus it is impossible to make selection to allow power to be provided to a predetermined heater resistor, the charges accumulated in the capacitor 204 are not discharged. Therefore, if a poor contact occurs in the connecting portion, the voltage of the capacitor 204 does not drop. As described above, power is supplied from the capacitor to the heater resistor and the CPU 200 senses the status of the capacitor 204 (whether the power is supplied to the heater resistor) through a VC terminal. This makes it possible to determine the presence of poor contact.

Furthermore, in order to secure the reliability of a serial data line, it is more desirable to make the setting for selecting none of the heaters and confirm that the voltage of the capacitor 204 is retained, followed by proceeding to the operation of selecting a predetermined heater resistor.

Furthermore, it is more desirable that there are more heater resistors which can be selected on an identical data line because this makes it possible to reduce load on one heater resistor.

Furthermore, only one pattern of combination of heater resistor is enough to be selected on an identical data line. This is because, in the case of a serial data line, any setting patterns may result in either no selection or proper selection if a poor contact has been occurred.

In addition, if the print head 205 has heater resistors to which a driving voltage is applied from different terminals T, it is necessary to provide power using the capacitor 204 at the different timing to determine whether a voltage drop occurs in the capacitor.

In the normal printing, both the DCDC converter 201 and the FET 203 are in the ON state. However, in the operation sequence of the present embodiment for inspecting a poor contact, the capacitor 204 is temporarily charged, followed by turning off at least the FET 203, so that a state is caused in which a power supply is provide for the printing head 205 only by the capacitor 204. The state is referred to as a charging energy limitation mode. In the charging energy limitation mode, limitation is of course imposed on energy so as to give no damage to the heater even if power is supplied to the heater resistor in the state where ink is not charged.

Namely, the amount of energy input to the heater resistor is preferably smaller than the amount of energy to be charged at the time of printing so that the heater resistor 410 is not damaged due to an excessive rise in temperature even in the state where no ink is charged yet. More specifically, this is achieved by setting the capacity of the capacitor 204 appropriately. Furthermore, as a result of the capacity of the capacitor 204 is set in that way, an electrical discharge by the heater resistor makes it possible to cause a voltage drop which can be sufficiently recognized by the CPU 200.

In addition, the heater resistor is used as an energy element for ejecting ink in the present embodiment. However, the energy element is not limited to this, but other elements, such as a piezo element, may be used.

As described above, the print head is mounted on the carriage, and power is supplied from the capacitor to each of the heaters before ink is charged to the print head, followed by confirming the presence of voltage drop in the capacitor 204. This has made it possible to achieve an ink jet printer capable of reliably detecting a poor connection of the connection terminal of the print head in a short time without wasting ink.

(Second Embodiment)

A second embodiment of the present invention will be described below with reference to drawings. In addition, since a basic structure of the present embodiment is the same as that in the first embodiment, only the distinctive structure will be described below.

Figure 3:
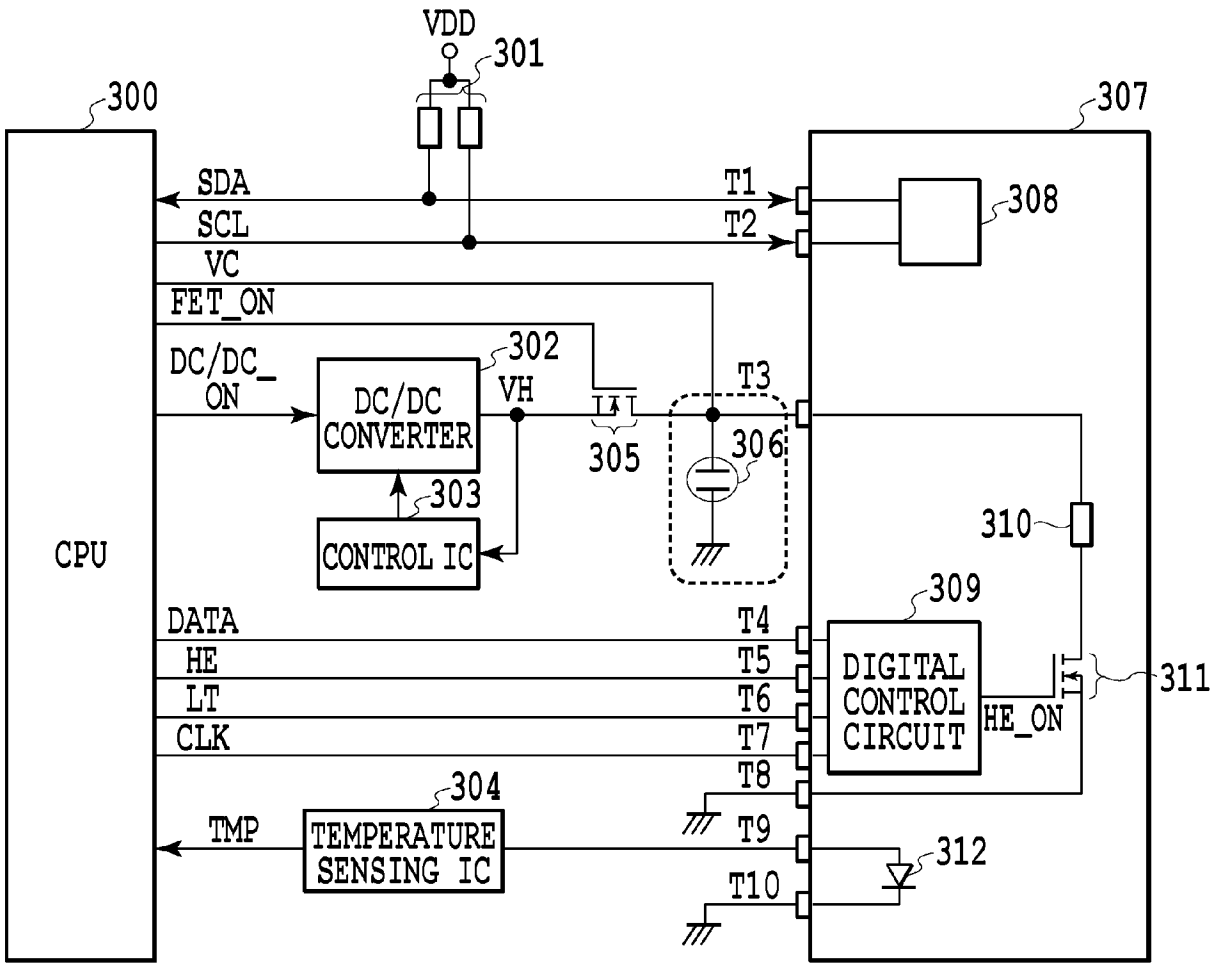
FIG. 3 is a block diagram showing an electrical connection in a printing apparatus main body.

FIG. 3 is a block diagram showing an electrical connection of the printing apparatus main body according to the second embodiment of the present invention. The present embodiment differs from the first embodiment in that a diode (second element) 312 for sensing temperature of the print head, and a storage element (first element) 308 for storing information of a print head 307 are added. Although a plurality of diodes 312 is actually provided at various portions of the print head 307, a single diode is illustrated here for ease of explanation.

As described above, the connecting portion between the print head 307 and the printing apparatus main body may include the storage element for sensing the temperature of the print head 307 or storing physical parameters of the print head 307, in addition to a signal line including a power supply line for driving the heater resistor in the print head. In such a printing apparatus, only a heater resistor driving system is insufficient, and thus it is necessary to confirm the connection of each of elements such as the storage element 308 and the diode 312.

First, with regard to a diode for sensing temperature of the print head 307, the connection is confirmed by applying a predetermined voltage to the diode and determining whether or not the voltage corresponding to VF of the diode is generated between both the ends of terminals. If a poor connection is generated, the voltage at the side of a measure of applying a current significantly rises beyond the voltage corresponding to VF a result of the fact that no diode current flow is caused. Furthermore, with regard to the storage element, the presence of the poor connection is determined by executing the serial communication with the storage element 308 and then determining whether or not data can be properly read out. Though the explanation is omitted here regarding the technology of improving the reliability of data, such as providing parity or check sum, because there have been a lot of disclosures thereof, determination of a part of readout data is sufficient if merely the poor contact is determined nonetheless.

Furthermore, it is desirable to implement the inspection of such elements other than the heater resistor driving system in advance of the heater resistor driving system. This is because the heater resistor driving system requires much more time to be inspected because of the preparation of the print head power supply VH and a large number of objects to be inspected, and accordingly the inspection can be performed in a short time in total if it is recognized that there is a poor contact in a control element other than those in the heater resistor driving system.

As described above, the print head 307 is mounted on the carriage, and the diode 312 and the storage element 308 are confirmed before charging ink to the print head 307, followed by energizing each of heaters from the capacitor 306 to confirm the presence of voltage drop in the capacitor 306. This has made it possible to achieve an ink jet printer capable of reliably detecting a poor connection of the connection terminal of the print head in a short time without wasting ink.

(Third Embodiment)

A third embodiment of the present invention will be described below with reference to drawings. In addition, since a basic structure of the present embodiment is the same as that in the first embodiment, only the distinctive structure will be described below.

Figure 4:
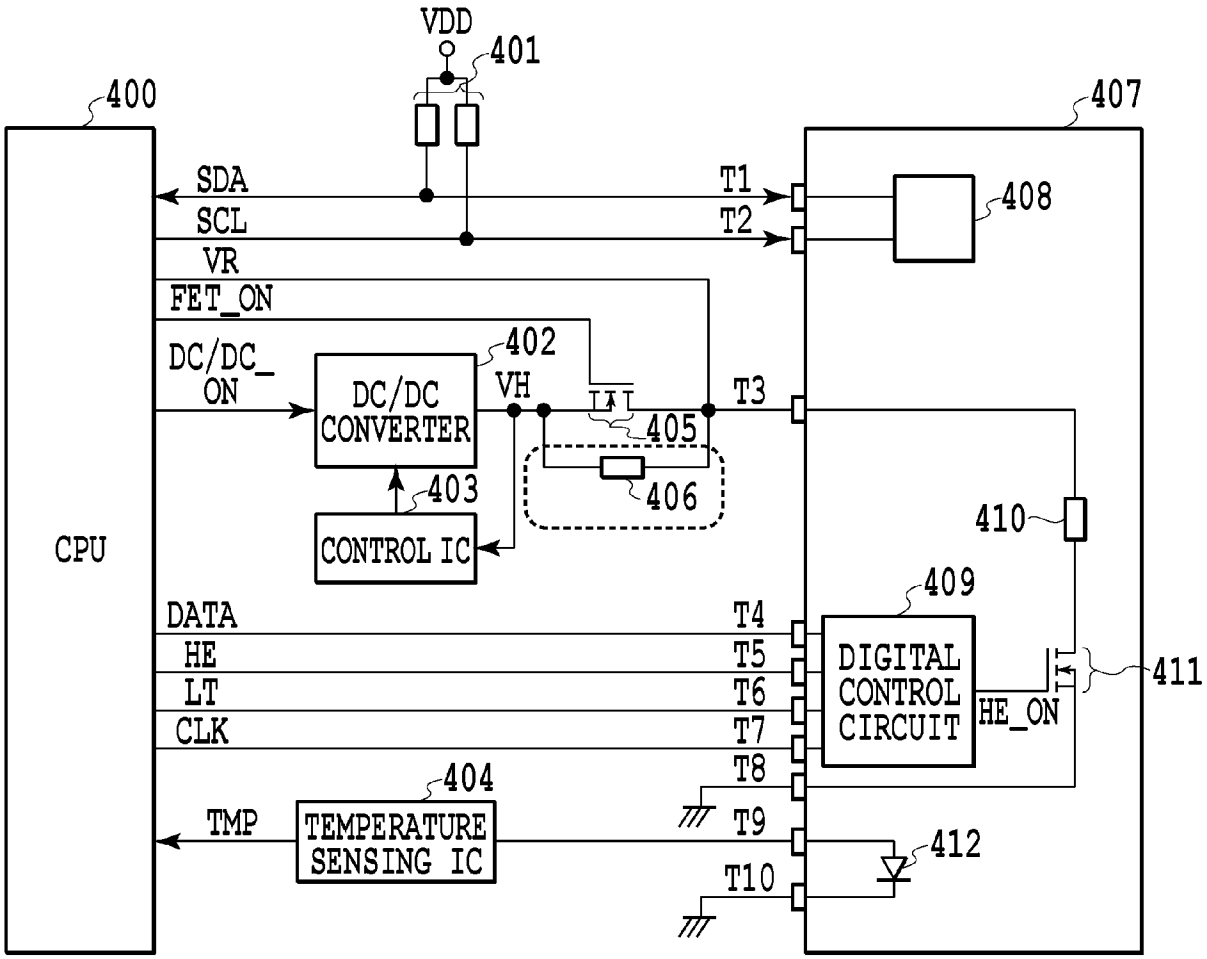
FIG. 4 is a block diagram showing an electrical connection in a printing apparatus main body.

FIG. 4 is a block diagram showing an electrical connection of the printing apparatus main body according to the third embodiment of the present invention. The present embodiment differs from the first embodiment in that, in the method for achieving the charging energy limitation mode, the capacitor 306 is omitted and a resistor element 406 is added instead thereof in parallel with an FET 405. The resistor element 406 is set to take a value in which a feeble current can be supplied to a print head 407.

In the charging energy limitation mode, a CPU 400 recognizes the voltage of almost VH through a VR terminal in the state where a DCDC converter 402 is turned on and the FET 405 is turned off, and where the print head 407 does not select any of the heater resistors. Here, when the CPU 400 gives the print head 407 a command to select a predetermined heater resistor 410, a current to the heater resistor 410 is generated, and the voltages of heater resistor 410 and a resistor element 406 are divided to be input to the CPU 400 (VR terminal).

At that time, the amount of energy input to the heater resistor 410 is preferably smaller than the amount of energy to be charged at the time of printing so that an excessive rise in temperature of the heater resistor is not caused in the state where no ink is charged yet. The CPU 400 determines that the heater resistor is properly selected, i.e., no poor contact exists in the heater resistor system, by monitoring the divided voltage of the VR terminal. The inspection of the connection of elements other than the heater resistor system is the same as that in the second embodiment.

As described above, the print head is mounted on the carriage, and power is supplied from the capacitor to each of the heaters before ink is charged to the print head, followed by confirming the input voltage which is a voltage divided for the heater resistor 410 and the resistor element 406. This has made it possible to achieve an ink jet printer capable of reliably detecting a poor connection of the connection terminal of the print head in a short time without wasting ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-053864, filed Mar. 15, 2013, which is hereby incorporated by reference herein in its entirety.

What is claimed is:

1. An ink jet printer, comprising:

a print head for ejecting ink from an ejection port by energizing an energy element;

a carriage to which the print head can be mounted;

a capacitor capable of energizing the energy element; and a determination device for determining that the print head is properly mounted in the case where an electric current is supplied to the energy element using the capacitor after mounting the print head on the carriage, and a voltage descent in the capacitor is detected, wherein the amount of energy to be input at the time of energizing the energy element using the capacitor is smaller than the amount of energy charged at the time of printing.

2. The ink jet printer according to claim 1, further comprising a charging device for charging ink from an ink tank to the print head in the case where the determination device determines that the print head is properly mounted.

3. The ink jet printer according to claim 1, wherein remounting of the print head is advised to a user in the case where the determination device determines that the print head is not properly mounted.

4. The ink jet printer according to claim 1, comprising:

a first element for storing information on the print head; and a second element for sensing temperature of the print head, wherein:

power is supplied to the energy element in the case where it is determined that outputs from the first element and the second element are normal after mounting the print head.

* * * * *